US008206051B2

(12) United States Patent
Sakurai et al.

(10) Patent No.: US 8,206,051 B2
(45) Date of Patent: Jun. 26, 2012

(54) COSMETIC-CONTAINING APPLICATOR AND REPLACEMENT BRUSH

(75) Inventors: Kiyokazu Sakurai, Fujioka (JP); Mitsuru Endou, Fujioka (JP); Tetsuaki Akaishi, Fujioka (JP); Hiroaki Koyama, Fujioka (JP); Masaaki Morita, Fujioka (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 685 days.

(21) Appl. No.: 12/224,308

(22) PCT Filed: Dec. 7, 2006

(86) PCT No.: PCT/JP2006/324464
§ 371 (c)(1),
(2), (4) Date: Mar. 11, 2009

(87) PCT Pub. No.: WO2007/097090
PCT Pub. Date: Aug. 30, 2007

(65) Prior Publication Data

US 2009/0304431 A1 Dec. 10, 2009

(30) Foreign Application Priority Data

Feb. 23, 2006 (JP) ..... 2006-046316

(51) Int. Cl.
*A46B 11/04* (2006.01)

(52) U.S. Cl. ..... 401/280; 401/269; 401/270; 401/281

(58) Field of Classification Search ..... 401/269, 401/270, 280, 281
See application file for complete search history.

(56) References Cited

U.S. PATENT DOCUMENTS 4,726,386 A * 2/1988 Schultz ..... 401/269
5,904,433 A * 5/1999 Kay ..... 401/269

FOREIGN PATENT DOCUMENTS

| | | | |
|---|---|---|---|
| FR | 2 629 525 | A1 | 10/1989 |
| JP | Hei-9-173139 | A | 7/1997 |
| JP | Hei-10-165878 | A | 6/1998 |
| JP | Hei-11-009336 | A | 1/1999 |
| JP | 2000-279873 | A | 10/2000 |
| JP | 2002-065338 | A | 3/2002 |

OTHER PUBLICATIONS

European Search Report dated Jul. 9, 2010, issued in European Patent Application No. 06834219.5-1258 /2000044.

* cited by examiner

*Primary Examiner* — Steven J Ganey
(74) *Attorney, Agent, or Firm* — Kubovcik & Kubovcik

(57) ABSTRACT

A cosmetic-containing applicator. The applicator is mounted, at its tip end, with an applicator body in which a flange-shaped engagement part is formed at an outer periphery at a rear end of a fiber bundle, comprising an accommodating part accommodating liquid cosmetics, a tip casing mounted on a tip end side of the accommodating part and formed with an insertion hole in which the applicator body (30) is mountable, a guiding part for guiding the cosmetics from the accommodating part to the applicator body, and a reduced-diameter part formed as an inwardly facing flange and reducing in diameter between the insertion hole and the guiding part. The reduced-diameter part is divided into claw-shaped holding pieces by slits, and its smallest-diameter part has a diameter smaller than an outer diameter of the engagement part.

9 Claims, 12 Drawing Sheets

COSMETIC-CONTAINING APPLICATOR AND REPLACEMENT BRUSH

This application is a 371 of international application PCT/JP2006/324464 filed Dec. 7, 2006, which claims priority based on Japanese Patent Application No. 2006-046316 filed Feb. 23, 2006, which is incorporated herein by reference.

TECHNICAL FIELD

The present invention relates to a cosmetic-containing applicator for applying liquid cosmetics contained therein by using a detachable replacement brush, and to the replacement brush.

BACKGROUND ART

There have conventionally been proposed various types of cosmetic-containing applicators provided with a fiber bundle such as a writing-brush-shaped brush at its tip end to be infiltrated with contained liquid cosmetics and to apply the cosmetics. Such a brush may become unusable because the brush is worn by repeated use or cosmetics adhering thereto become hard. Therefore, some brushes are made replaceable.

Examples of such cosmetic-containing applicators have been disclosed as inventions described in Patent Documents 1 and 2 shown below.

In the inventions disclosed in Patent Documents 1 and 2, in a writing-implement-type liquid cosmetic container, a writing-brush-shaped applying part at the tip end is made detachable, and the writing-brush-shaped applying part together with its surrounding members is attached and detached as a unit.

Further, the invention disclosed in Patent Document 3 relates to improvement of installation and assembly of brushes, and does not assume the replacement of the brushes.

Patent Document 1: JP 9-173139 A
Patent Document 2: JP 2002-65338 A
Patent Document 3: JP 2000-279873 A

DISCLOSURE OF THE INVENTION

In the above-described cosmetic-containing applicator, since the bristles of the brush used are soft and tend to spread toward the tip, it is difficult to replace the brush alone. Moreover, if an attempt is made to replace the brush as a single unit, it is difficult to hold the brush so as not to drop off after the replacement since the brush is wholly soft. Thus, although the brush has conventionally been replaced together with its surrounding members as in the invention disclosed in Patent Document 1 or 2, a specific complicated structure such as an engagement structure, a screwing structure, or the like for attachment and detachment is required, and consequently the shape of the cosmetic-containing applicator is obliged to be large. Furthermore, there occurs a problem that the cost increases caused by the increase of the number of replacement parts.

Thus, a first object of the present invention is to provide a cosmetic-containing applicator in which a fiber bundle such as a brush is replaceable in a single unit and is reliably mountable after the replacement.

Moreover, a second object of the present invention is to provide a replacement brush capable of being replaced easily as described above.

(1) First Invention

In the light of the above-mentioned first object, a first invention of the present invention provides a cosmetic-containing applicator mounted, at its tip end, with an applicator body in which a flange-shaped engagement part is formed at an outer periphery at a rear end of a fiber bundle, comprising:

an accommodating part accommodating liquid cosmetics;

a tip casing mounted on a tip end side of the accommodating part and formed with an insertion hole in which the applicator body is mountable;

a guiding part for guiding the cosmetics from the accommodating part to the applicator body in the tip casing; and a reduced-diameter part formed as an inwardly facing flange and reducing in diameter between the insertion hole and the guiding part;

the reduced-diameter part being divided into a plurality of claw-shaped holding pieces by a plurality of slits, and its smallest-diameter part having a diameter smaller than an outer diameter of the engagement part; and the applicator body is inserted in the insertion hole of the tip casing from its rear end, and being mounted in position by causing the engagement part to pass through rearward by elastic deformation of the engagement part and the holding pieces.

The applicator body according to the present invention may have any specific properties only if being formed by a fiber bundle. For example, the applicator body may be formed by hardening fibers with an adhesive or the like. Moreover, it may have a brush-shaped form in which each of the fibers is independent. In this case, only the rear end part thereof must be bundled or hardened with an adhesive or the like.

Between the accommodating part and the applicator body, the guiding part for guiding the cosmetics is interposed. The applicator body is mounted in the insertion hole in the tip casing. Between the insertion hole and the guiding part, the reduced-diameter part is provided. The reduced-diameter part may be a flange-shaped structure in which a part of the insertion hole is projected inward, or may be a flange-shaped structure in which a part of the guiding part is projected inward. Further, the reduced-diameter part may be formed as a part of a member formed as a packing member (e.g. a sealing ring) between the tip casing and the guiding part. Moreover, for example, the insertion hole and the guiding part may be formed as a series of tubular structure, and the reduced-diameter part may be provided as the boundary therebetween.

The reduced-diameter part is divided by the plurality of slits, by which the flexibility is increased and elastic deformation is made easy to occur. The diameter of an inscribed circle with respect to the tip end of each of the holding pieces formed by being divided is smaller than the outer diameter of the engagement part.

When the applicator body is mounted in the tip casing, the applicator body is inserted into the insertion hole from its rear end. Then, the engagement part located at the rear end of the applicator body once comes into contact with the front side of the holding pieces of the reduced-diameter part. When the applicator body is further pushed rearward from this position, the engagement part and the holding pieces are elastically deformed by each other. That is to say, the inner diameter of the holding pieces is increased, or the outer diameter of the engagement part is decreased, or both occur. As a result, the engagement part can pass through the inner diameter of the holding pieces.

Then, after the engagement part has passed through rearward from the position of the holding pieces, the elastic deformation vanishes, and therefore the engagement part and the holding pieces restore to the original size. Thus, the applicator body is mounted in the tip casing in a usable manner. Since the outer diameter of the engagement part located at the rear of the holding pieces is larger than the inner diameter of the holding pieces, the engagement part does not pass through again to the front of the holding pieces unless the applicator body is pulled forward by being gripped with fingers.

On the other hand, when the mounted applicator body is pulled forward by being gripped with fingers, the engagement part comes into contact with the rear side of the holding pieces. The engagement part and the holding pieces are elastically deformed again by each other, and the engagement part passes through to the front of the holding pieces. Thus, the applicator body 30 is removed.

Further, the present first invention may be configured as a cosmetic-containing applicator mounted, at its tip end, an the applicator body in which a flange-shaped engagement part is formed at an outer periphery at a rear end of a fiber bundle, comprising:

a rear casing provided with an accommodating part accommodating liquid cosmetics;

a tip casing mounted at a tip end of the rear casing and formed with an insertion hole through which the applicator body is insertable;

a guiding part for guiding the cosmetics from the accommodating part to the applicator body in the tip casing; and a sealing ring interposed between the guiding part and the tip casing;

a rear end part of the insertion hole in the tip casing being formed as a holding space 13 having an increased inner diameter;

a tip end part of the guiding part fitting in the holding space via the sealing ring;

the sealing ring being formed of an elastically deformable material so as to have a shape in which a substantially short cylindrical holding part, which has a bottom surface having an inner diameter larger than an outer diameter of the engagement part and is provided with a circular center hole having a diameter smaller than the outer diameter of the engagement part on its rear end side, and a flange-shaped sealing part, which is provided at an outer periphery at a tip end edge of the holding part, are integrated together;

a circumference of the center hole being formed as a plurality of claw-shaped holding pieces formed by slits dividing the bottom surface into a plurality of pieces; and the applicator body being inserted in the insertion hole in the tip casing from its rear end, and being mounted in position by causing the engagement part to pass through the center hole in the bottom surface of the sealing ring by elastic deformation.

That is to say, the holding pieces may be formed so that the bottom surface that is a part of the sealing ring formed separately from the tip casing and the accommodating part is used as the reduced-diameter part, and is divided by the slits surrounding the center hole.

In this configuration, each of the above-mentioned elements is formed, for example, as described below.

First, the guiding part is mounted at the tip end of the rear casing. The rear end of the guiding part communicates directly with the accommodating part, or communicates with the accommodating part via a structure for guiding the cosmetics from the accommodating part.

On the other hand, in the holding space in the tip casing, the sealing ring is inserted with its sealing part directed to the tip end.

Next, the tip casing is mounted at the tip end of the rear casing, for example, by screwing or fitting. At this time, the tip end of the guiding part fits in the holding space and thereby includes the holding part of the sealing ring, and also holds the sealing part between the rear end of the holding space. Then, the cosmetics accommodated in the accommodating part in the rear casing are guided to the applicator body in the tip casing through the guiding part, and are applied to a desired location after infiltrating the applicator body.

Then, the applicator body is mounted through the insertion hole at the tip end of the tip casing. When the applicator body is formed by hardening a fiber bundle with an adhesive or the like, it can be inserted into the insertion hole as it is. Moreover, when the applicator body is brush-shaped, it can be inserted into the insertion hole easily if its side surface is covered, in advance, with a protective cylinder having an outer diameter approximately equal to the inner diameter of the insertion hole.

After the applicator body is inserted in the insertion hole in the tip casing, the engagement part at the rear end of the applicator body soon comes into contact with the inside of the bottom surface of the sealing ring. When the applicator body is further pushed rearward from this position, the engagement part pushes the bottom surface.

Since the sealing ring is formed of an elastically deformable material, for example, a relatively soft synthetic resin such as polypropylene, the holding part of the sealing ring is deflected outward by elastic deformation caused by the pushing of the engagement part. Then, the center hole is expanded, so that the engagement part can pass through it. After the engagement part has passed through the position of the center hole, the deflection of the holding part of the sealing ring is restored, and the diameter of the center hole returns to the original one. Thereby, the engagement part is held in the state in which it does not come off the bottom surface of the sealing ring. Then, when the applicator body is covered with the protective cylinder, the mounting of the applicator body is finished by pulling out the protective cylinder toward the tip end direction. In this state, for example, even if the tip end is directed downward, the engagement part is caught by the bottom surface of the sealing ring, so that the applicator body does not come off the tip casing spontaneously.

On the other hand, when the applicator body comes to be worn and to require to be replaced, the applicator body being pulled toward the tip end direction, the engagement part elastically deforms the holding part of the sealing ring again and passes through the center hole, thereby the applicator body can be removed from the insertion hole.

Further, though the arrangement of the slits is not subject to any special restriction, the slits are preferably arranged at equal intervals from the viewpoints of the stability of construction and the ease of molding.

In this case, the slits may be provided at two locations, and each of the holding pieces may be provided with an opening. Thus, a shortage of flexibility produced by the slits provided at only two locations can be compensated by the openings.

On the other hand, the side surface portion of each of the holding pieces may be formed into a columnar shape by further forming notches from the slits located on both sides of each of the holding pieces. Thus, the flexibility of the holding pieces is increased, by which the mounting can be performed more easily, and the sealing ring can be formed of a less elastic material.

Further, the cosmetic-containing applicator may be so configured that the applicator body is formed by providing the engagement part at the outer periphery at the rear end of the brush-shaped fiber bundle formed as a bristle bundle a front end of which is open and a rear end of which is bundled, and the side surface of the applicator body is covered with the detachable protective cylinder having an inner diameter smaller than the outer diameter of the engagement part; that the applicator body is mounted in the tip casing by causing the engagement part to pass through to the rearward in the holding pieces by elastic deformation of the engagement part and the holding pieces caused by being pressed rearward with the protective cylinder; that the applicator body is made usable by the protective cylinder being pulled out forward and removed after the applicator body has been mounted in position; and that the applicator body mounted in the tip casing can be demounted from the tip casing by causing the engagement part to pass through forward in the holding pieces by elastic deformation of the engagement part and the holding pieces caused by the applicator body being pulled forward.

Thus, even when the applicator body is formed by a less rigid brush-shaped fiber bundle, elastic deformation can be caused by pressing the engagement part rearward with respect to the holding pieces due to the rigidity of the protective cylinder. Moreover, after the applicator body has been mounted, the applicator body can be made usable quickly by pulling out the protective cylinder forward.

(2) Second Invention

In the light of the above-mentioned second object, a second invention of the present invention provides a replacement brush comprising an applicator body in which a flange-shaped engagement part is formed at an outer periphery of a rear end of a brush-shaped fiber bundle formed as a bristle bundle a front end of which is open and a rear end of which is bundled, a side surface of the applicator body being covered with a detachable protective cylinder having an outer diameter approximately equal to an inner diameter of an insertion hole of a cosmetic-containing applicator in which the applicator body is mounted.

That is to say, the replacement brush according to the second invention is used as the applicator body in the cosmetic-containing applicator according to the first invention.

Because of being covered with the protective cylinder, the bristle bundle does not spread, and can be inserted easily in the insertion hole in the tip casing. Further, after the mounting has been finished, the replacement brush can be made usable quickly by pulling out the protective cylinder.

The present invention achieves the effects described below because of being configured as described above.

That is to say, according to the first invention of the present invention, in the cosmetic-containing applicator, the brush is replaceable in a single unit and is reliably mountable after replacement.

Moreover, according to the second invention of the present invention, the replacement brush capable of being replaced easily as described above can be provided.

BEST MODE FOR CARRYING OUT THE INVENTION

Embodiments of the present invention will now be described with reference to the accompanying drawings.

(1) First Embodiment

Figure 1:
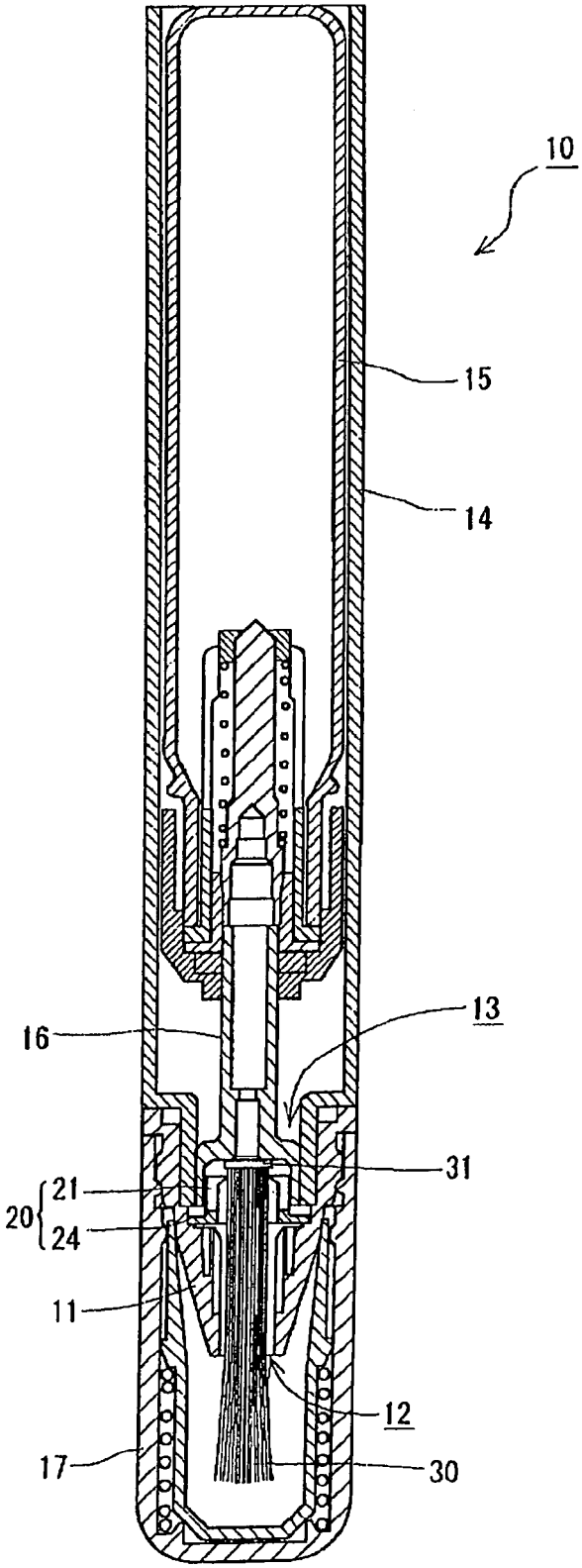
FIG. 1 A front sectional view of a cosmetic-containing applicator according to a first embodiment of the present invention.

FIG. 1 is a front sectional view of a cosmetic-containing applicator 10 according to a first embodiment of the present invention.

A rear casing 14 is made of a thermoplastic resin (e.g., polypropylene, polyethylene, polybutylene terephthalate, etc. The same goes for the description below), and at the outer periphery in its tip end part, external screw is formed to be screwed to a tip casing 11. Moreover, the rear casing 14 houses an accommodating part 15 that contains liquid cosmetics. Further, to the tip end of the accommodating part 15, a thermoplastic-resin made tubular guiding part 16 for guiding the cosmetics is connected. Both of the inner diameter and the outer diameter of the tip end part of the guiding part 16 are widened.

On the other hand, the tip casing 11 is made of a thermoplastic resin, and at the inner periphery in its tip end part, internal screw is formed so that the tip casing 11 is screwed to the rear casing 14. Moreover, at the tip end of the tip casing 11 screwed to the rear casing 14, a cap 17 for protecting the tip end when the applicator 10 is not in use is detachably mounted.

The tip casing 11 is formed with an insertion hole 12 serving as a penetrating hole through which an applicator body 30 is inserted. Further, the rear end part of the insertion hole 12 has an increased inner diameter, by which a holding space 13 is formed. A sealing ring 20 is fitted in the holding space 13, and the tip end part of the guiding part 16 is also positioned so as to wrap the sealing ring 20.

Figure 2:
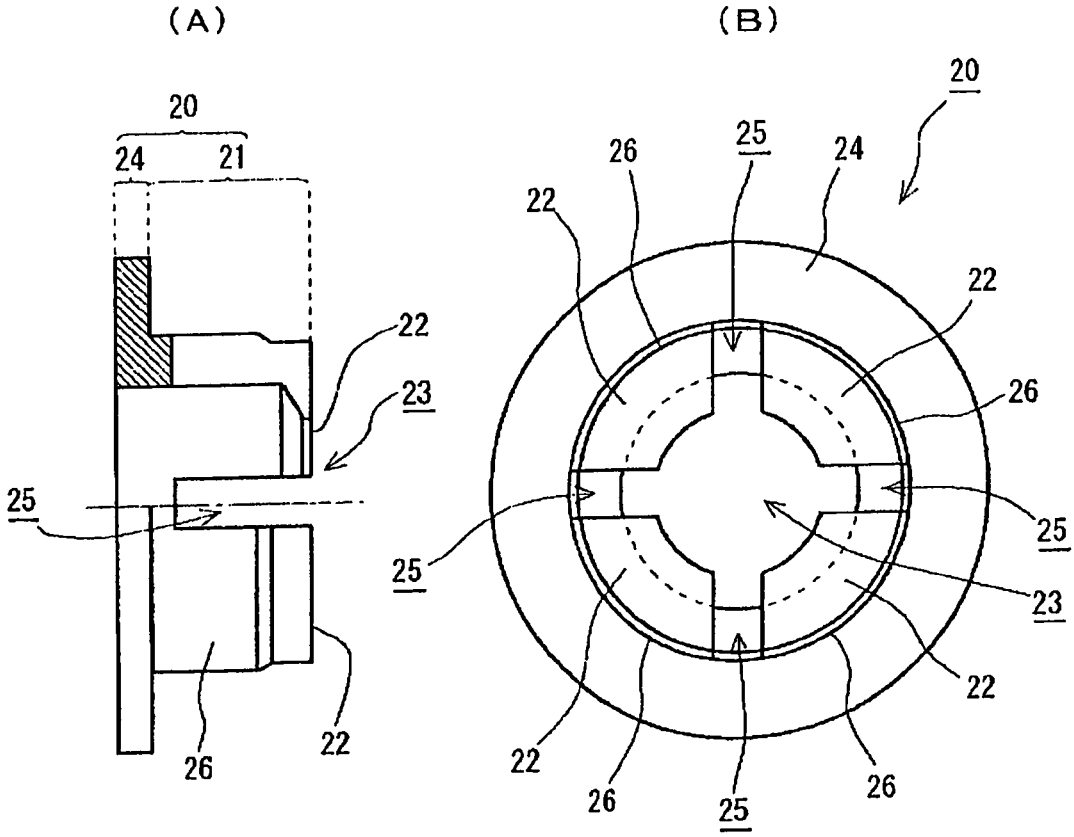
FIG. 2 A partially sectioned front view (A) and a plan view (B) of a sealing ring used for a cosmetic-containing applicator according to a first embodiment of the present invention.

The sealing ring 20 is made of a thermoplastic resin, and, as shown in FIG. 2, is formed by integrally molding a substantially short cylindrical holding part 21 and a sealing part 24 located on the tip end side of the holding part 21.

As shown in FIG. 1, the sealing part 24 is held between the rear end surface of the holding space 13 of the tip casing 11 and the tip end of the guiding part 16, by which the sealing function is accomplished.

On the other hand, as shown in FIG. 2(B), the holding part 21 has, on its rear end side, a bottom surface 22 in which a circular center hole 23 is opened. Further, four slits 25 arranged at equal intervals of 90 degrees are provided radially from the center hole 23. As shown in FIG. 2(A), the slits 25 reach the vicinity of the sealing part 24. That is to say, the holding part 21 is divided into four pieces by the slits 25, and each of the pieces serves as a holding piece 26 having a claw-shaped structure projecting in the center direction in the rear end part (refer to the partially sectioned portion of FIG. 2(A)).

Referring again to FIG. 1, as described above, the brush-shaped applicator body 30 is inserted through the insertion hole 12 in the tip casing 11.

Figure 3:
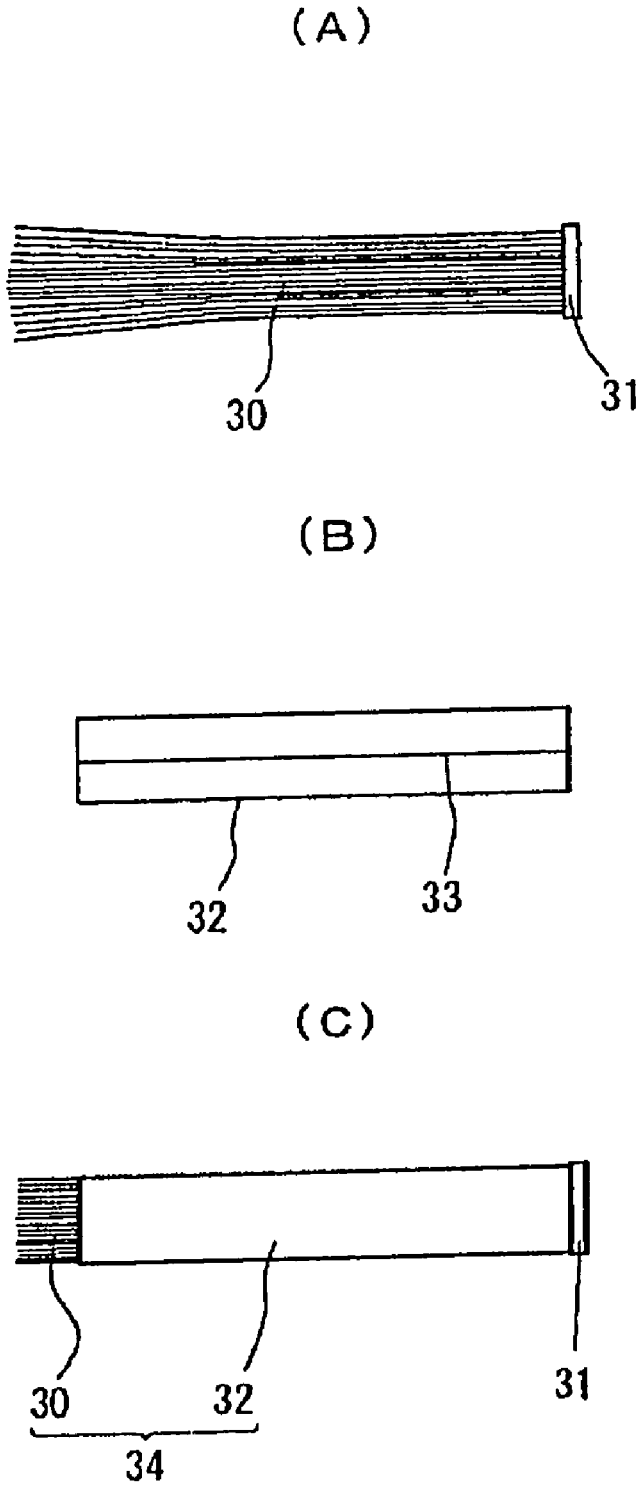
FIG. 3 Front views of an applicator body (A), a protective cylinder for covering the applicator body (B) and a replacement brush (C) used for a cosmetic-containing applicator according to a first embodiment of the present invention.

As shown in FIG. 3(A), the applicator body 30 is formed as a fiber bundle formed by stiffening and bundling the rear end side of the brush-shaped fibers by using an adhesive. Then, at its rear end, a flange-shaped engagement part 31 is formed. As shown in FIG. 1, the outer diameter of the engagement part 31 is larger than the diameter of the center hole 23 in the sealing ring 20. As shown in FIG. 3(B), the outside of the applicator body 30 is covered with a cylindrical protective cylinder 32 having a slit 33 extending in the lengthwise direction over the entire length, by which a replacement brush 34 shown in FIG. 3(C) is formed.

Next, the mounting and demounting of the applicator body 30 to and from the cosmetic-containing applicator 10 are explained.

Figure 4:
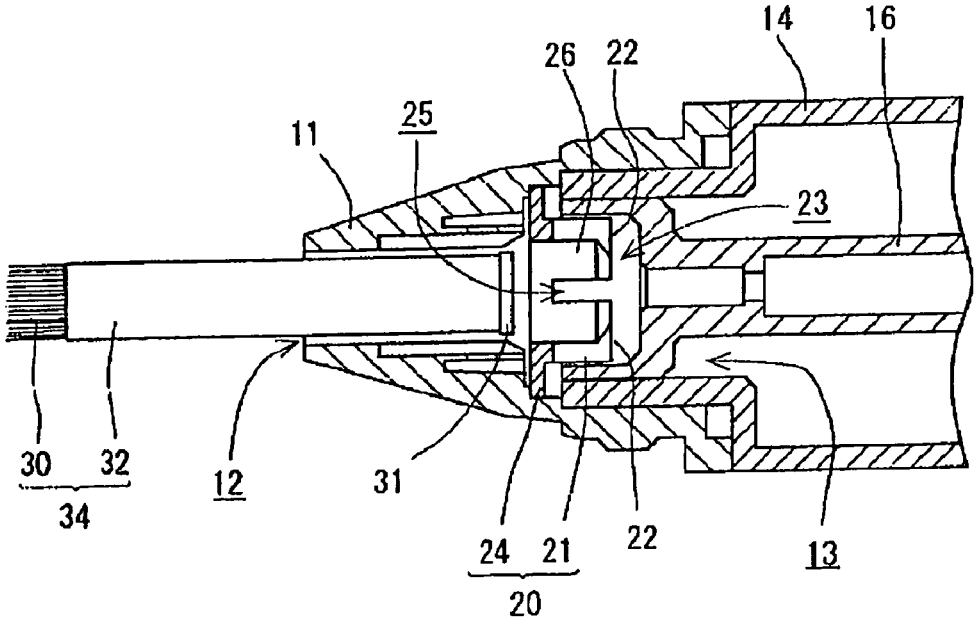
FIG. 4 A front sectional view showing a mounting state of an applicator body to a cosmetic-containing applicator according to a first embodiment of the present invention.

First, as shown in FIG. 4, the replacement brush 34 is inserted into the insertion hole 12 of the tip casing 11 together with the protective cylinder 32 from the engagement part 31. At this time, since the applicator body 30 is covered with the protective cylinder 32, the difficulty in insertion caused by the spread of the tip part of the brush-shaped applicator body 30 can be avoided.

Figure 5:
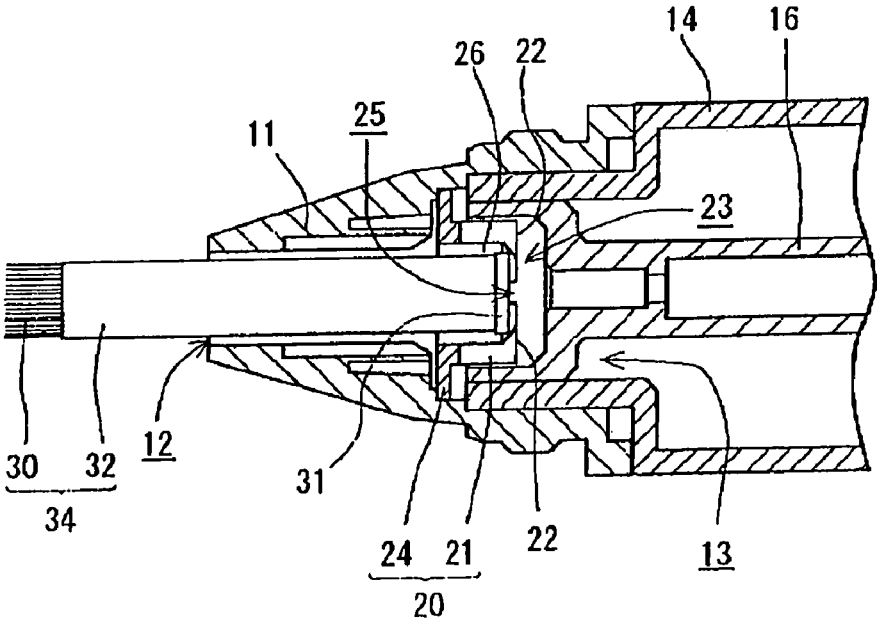
FIG. 5 A front sectional view showing a mounting state of an applicator body to a cosmetic-containing applicator according to a first embodiment of the present invention.
Figure 6:
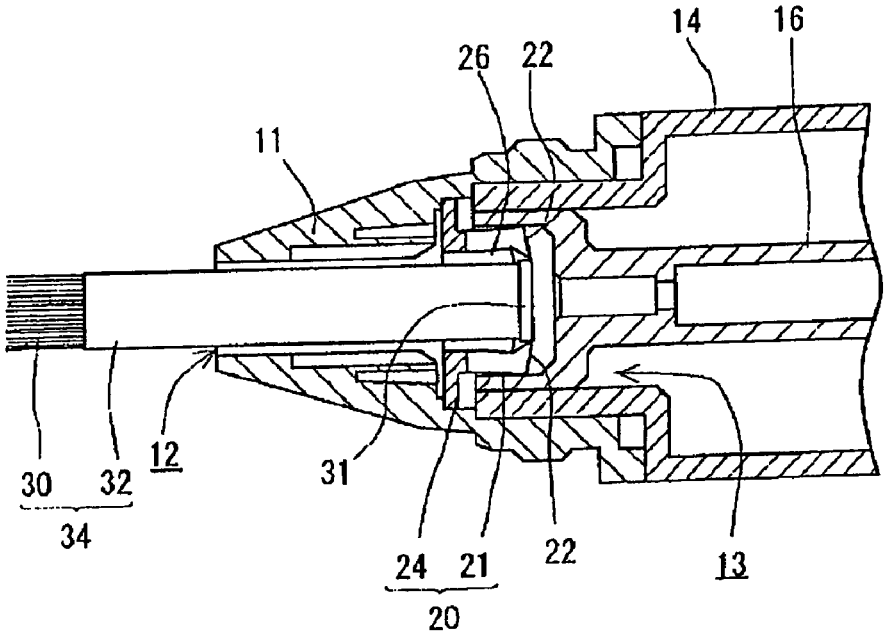
FIG. 6 A front sectional view showing a mounting state of an applicator body to a cosmetic-containing applicator according to a first embodiment of the present invention.

Then, continuing the insertion of the replacement brush 34, the engagement part 31 is soon brought into contact with the tip end surface of the claw-shaped structure of the holding part 21 as shown in FIG. 5. Further continuing the insertion of the replacement brush 34 from this position, the engagement part 31 forces to enlarge the holding part 21, by which the holding part 21 is deflected outward as shown in FIG. 6, and the diameter of the center hole 23 is increased. At this time, for example, if the holding part 21 is pressed rearward by the brush-shaped applicator body 30 alone, the rigidity of the holding piece 26 cannot be overcome. In this embodiment, however, since the replacement brush 34 is covered with the protective cylinder 32, the protective cylinder 32 plays a role in strengthening the rearward pressing force.

Figure 7:
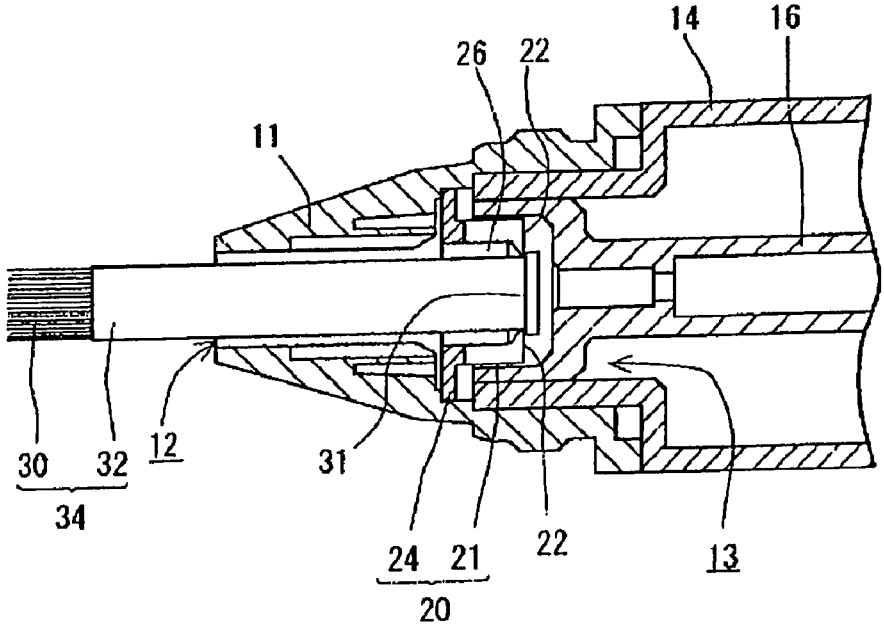
FIG. 7 A front sectional view showing a mounting state of an applicator body to a cosmetic-containing applicator according to a first embodiment of the present invention.

Then, when the engagement part 31 has passed through the center hole 23 having an increased diameter, the deflected holding part 21 returns to its original state, and, as shown in FIG. 7, the engagement part 31 is located at the rear of the bottom surface 22 of the sealing ring 20. At this time, a resisting feeling to the pressing disappears at the same time that a soft click sound is produced, so that the user is informed that the replacement brush 34 has reached the mounting position.

Figure 8:
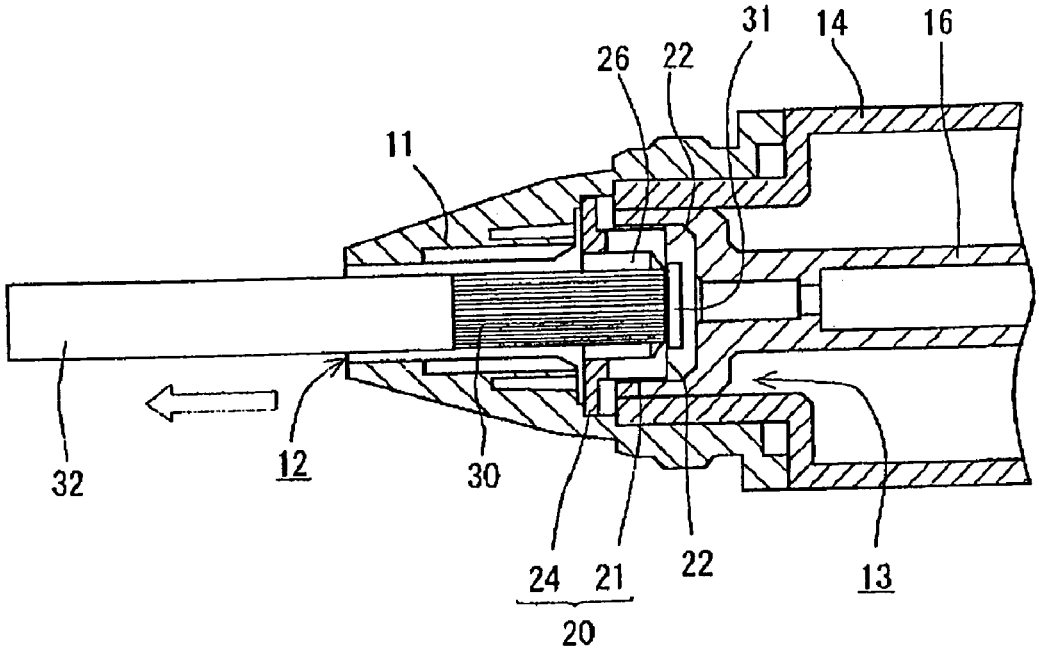
FIG. 8 A front sectional view showing a mounting state of an applicator body to a cosmetic-containing applicator according to a first embodiment of the present invention.

Finally, as shown in FIG. 8, the protective cylinder 32 is pulled out in the tip end direction, by which the mounting of the applicator body 30 is finished. In this state, the cosmetics contained in the accommodating part 15 are transmitted in the guiding part 16 and guided to the applicator body 30 so that the cosmetics can be applied to a desired location in a state of infiltrating the applicator body 30.

Figure 9:
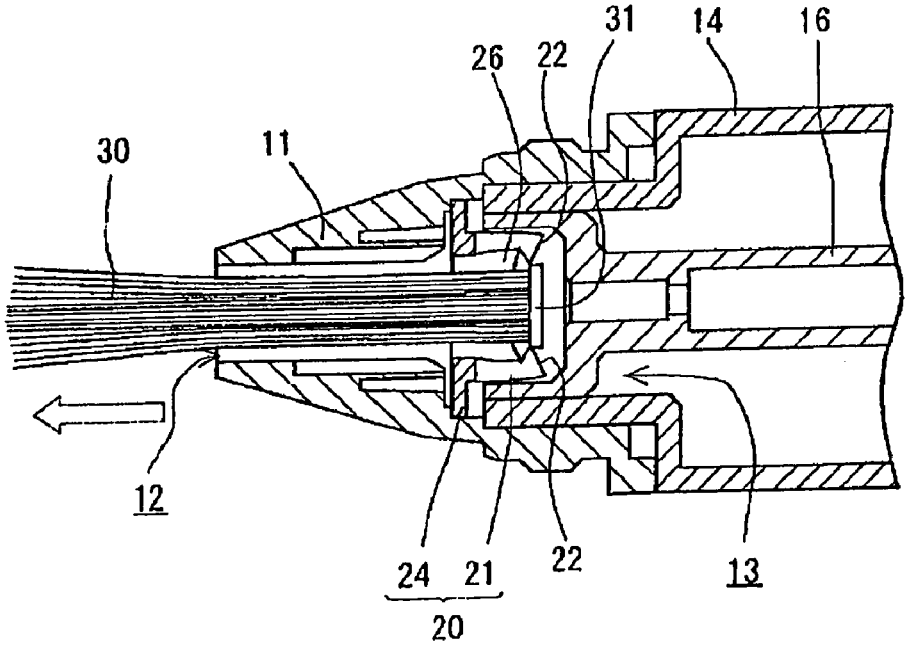
FIG. 9 A front sectional view showing a demounting state of an applicator body to a cosmetic-containing applicator according to a first embodiment of the present invention.

When the applicator body 30 having been mounted at present is removed for replacement, a portion exposed from the tip casing 11 is gripped and pulled in the tip end direction. Thus, as shown in FIG. 9, the bottom surface 22 of the sealing ring 20 is pressed from the rear by the engagement part 31, thereby the holding piece 26 being deflected outward, and the diameter of the center hole 23 is increased. After the engagement part 31 has passed through the center hole 23 having the increased diameter, the applicator body 30 can be pulled out with no resistance. Thus, the removal of the applicator body 30 is finished.

(2) Second Embodiment

Figure 10:
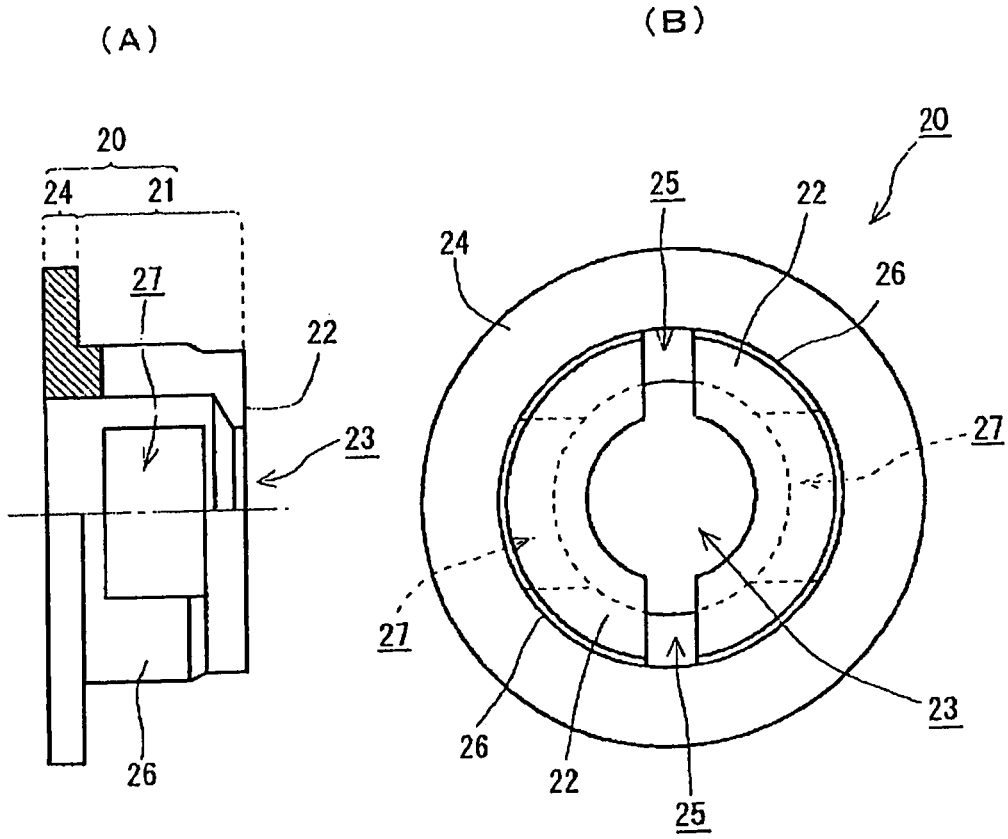
FIG. 10 A partially sectioned front view (A) and a plan view (B) of a sealing ring used for a cosmetic-containing applicator according to a second embodiment of the present invention.

A second embodiment of the present invention differs from the first embodiment in only that a sealing ring 20 having a shape shown in FIG. 10 is provided. Specifically, the second embodiment is the same as the first embodiment in that the sealing ring 20 is formed by a sealing part 24 and a holding part 21, but differs in that only two slits 25 are provided at equal intervals of 180 degrees. Further, openings 27 are provided at the positions of 90 degrees from the slits 25 in the side surfaces of holding pieces 26 formed by being divided into two pieces by the slits 25.

That is to say, the holding piece 26 formed by dividing the holding body into two pieces has high rigidity as compared with the case where the holding body is divided into four pieces, so that the holding pieces 26 is less liable to deflect even if being pressed by an engagement part 31. However, by providing the opening 27, the flexibility of the holding piece 26 can be increased, so that the holding part 21 can be deflected easily by the pressing of the engagement part 31.

The mounting and demounting of the applicator body 30 to and from the cosmetic-containing applicator 10 according to this embodiment are the same as described in the first embodiment.

(3) Third Embodiment

Figure 11:
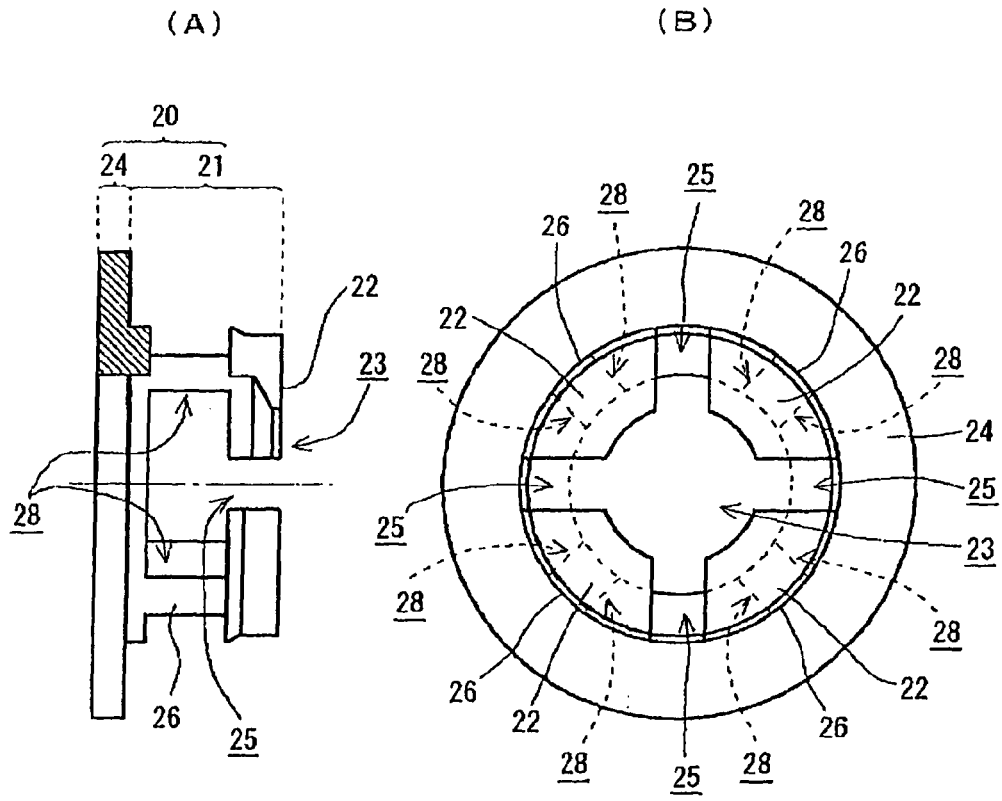
FIG. 11 A partially sectioned front view (A) and a plan view (B) of a sealing ring used for a cosmetic-containing applicator according to a third embodiment of the present invention.

A third embodiment of the present invention differs from the first and second embodiments in only that a sealing ring 20 having a shape shown in FIG. 11 is provided. Specifically, the third embodiment is the same as the first embodiment in that the sealing ring 20 is formed by a sealing part 24 and a holding part 21 and that four slits 25 are provided at equal intervals of 90 degrees, but differs in that notches 28 are further formed from the slits 25 located on both sides of each of holding pieces 26 in the side surface portions of the holding pieces 26.

Thereby, the side surface portion of the holding pieces 26 can be made slender as a columnar shape. This embodiment is useful in securing the flexibility of the holding piece 26, for example, even when the sealing ring 20 is molded by using a harder material.

The mounting and demounting of the applicator body 30 to and from the cosmetic-containing applicator 10 according to this embodiment are the same as described in the first embodiment.

(4) Fourth Embodiment

Figure 12:
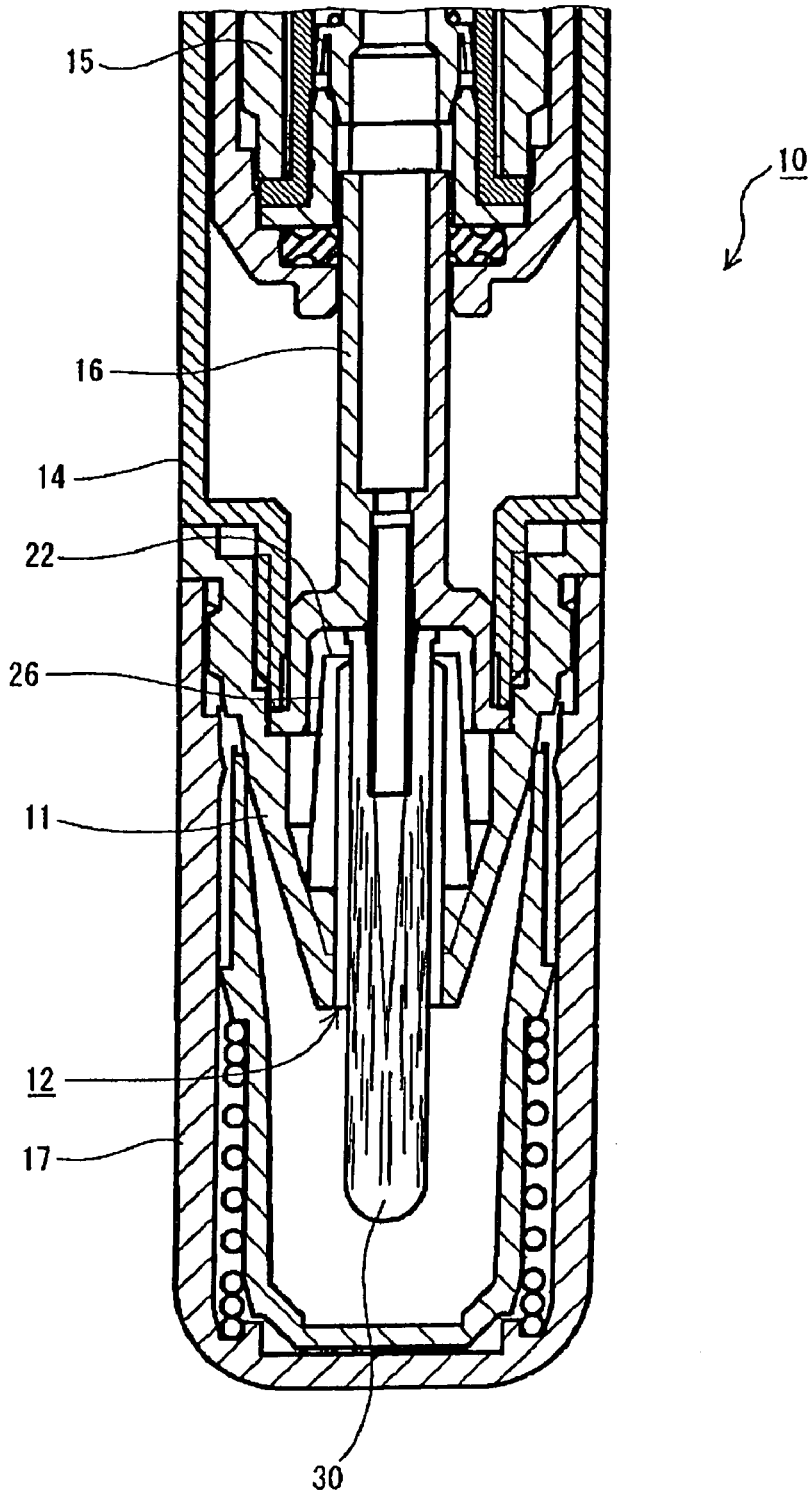
FIG. 12 A front sectional view of a cosmetic-containing applicator according to a fourth embodiment of the present invention.

FIG. 12 is a front sectional view of the cosmetic-containing applicator 10 according to a fourth embodiment of the present invention.

A rear casing 14 is made of a thermoplastic resin, and at the outer periphery in its tip end part, external screw is formed to be screwed to a tip casing 11. Moreover, the rear casing 14 houses an accommodating part 15 that contains liquid cosmetics. Further, to the tip end of the accommodating part 15, a thermoplastic-resin made tubular guiding part 16 for guiding the cosmetics is connected. Both of the inner diameter and the outer diameter of the tip end part of the guiding part 16 are widened.

On the other hand, the tip casing 11 is made of a thermoplastic resin, and at the inner periphery in its tip end part, internal screw is formed so that the tip casing 11 is screwed to the rear casing 14. Moreover, at the tip end of the tip casing 11 screwed to the rear casing 14, a cap 17 for protecting the tip end when the applicator 10 is not in use is detachably mounted.

Figure 13:
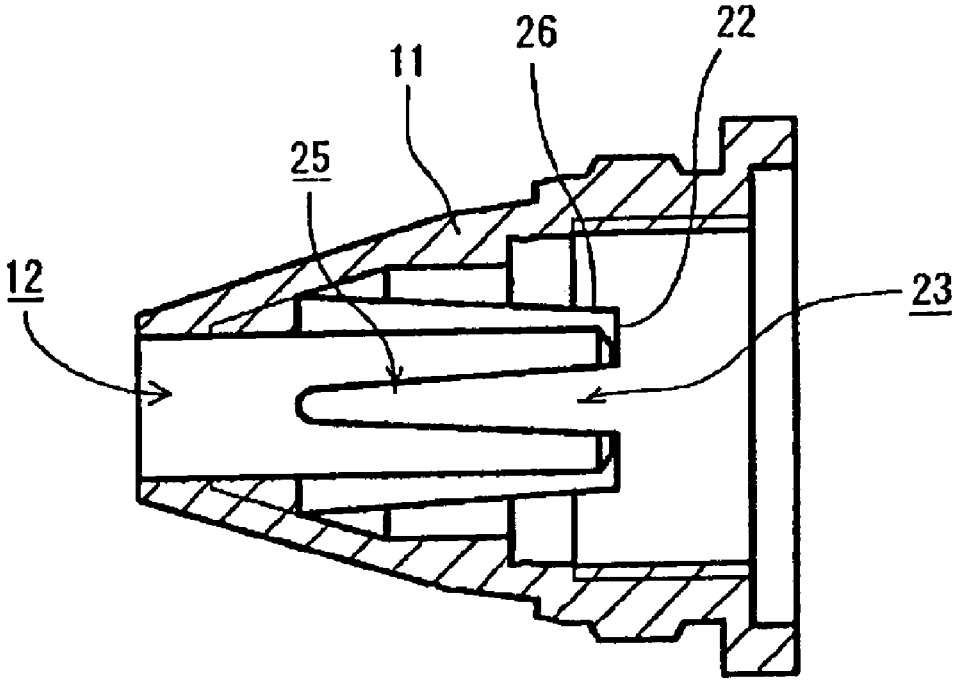
FIG. 13 A front sectional view of a tip casing used for a cosmetic-containing applicator according to a fourth embodiment of the present invention.

The tip casing 11 is formed with an insertion hole 12 serving as a penetrating hole through which an applicator body 30 is inserted. Further, the rear end part of the insertion hole 12 extends into the interior of the tip end part having an increased diameter of the guiding part 16, and the inner diameter of its rear end edge is decreased, by which a bottom surface 22 provided with a circular center hole 23 is formed. Further, four slits 25 arranged at equal intervals of 90 degrees are provided radially from the center hole 23. As shown in FIG. 13, the slit 25 reaches a position beyond the half of the length of the insertion hole 12. That is to say, the rear end part of the insertion hole 12 is divided into four parts by the slits 25, and each of the four parts serves as a holding piece 26 having a claw-shaped structure projecting in the center direction in the rear end part.

Referring again to FIG. 12, as described above, the brush-shaped applicator body 30 is inserted through the insertion hole 12 in the tip casing 11.

As in the first embodiment, as shown in FIG. 3(A), the applicator body 30 is formed as a fiber bundle formed by stiffening and bundling the rear end side of the brush-shaped fibers by using an adhesive. Then, at its rear end, a flange-shaped engagement part 31 is formed. As shown in FIG. 12, the outer diameter of the engagement part 31 is larger than the diameter of the center hole 23 that is a smallest-diameter part of the holding pieces 26. As shown in FIG. 3(B), the outside of the applicator body 30 is covered with a cylindrical protective cylinder 32 having a slit 33 extending in the lengthwise direction over the entire length, by which a replacement brush 34 shown in FIG. 3(C) is formed.

The holding piece 26 in this embodiment is provided with flexibility by the slit 25, and can accomplish the same function as that of the holding piece 26 formed as a part of the sealing ring 20 in the first embodiment.

Specifically, when the replacement brush 34 is inserted into the insertion hole 12, the engagement part 31 comes into contact with the smallest-diameter part of the holding pieces 26, and presses it rearward. Then, the center hole 23 is forced open by the engagement part 31, by which the engagement part 31 and the center hole 23 are elastically deformed by each other. After the engagement part 31 has passed through the center hole 23, the holding pieces 26 restore to their original positions. That is to say, since the outer diameter of the engagement part 31 is larger than the diameter of the center hole 23 as shown in FIG. 12, the frontward movement of the engagement part 31 is hindered. Successively, the protective cylinder 32 is pulled out, by which the mounting of the applicator body 30 is finished. Further, the removal of the applicator body 30 can also be accomplished as in the first embodiment by pulling out the applicator body 30 forward.

(5) Fifth Embodiment

Figure 14:
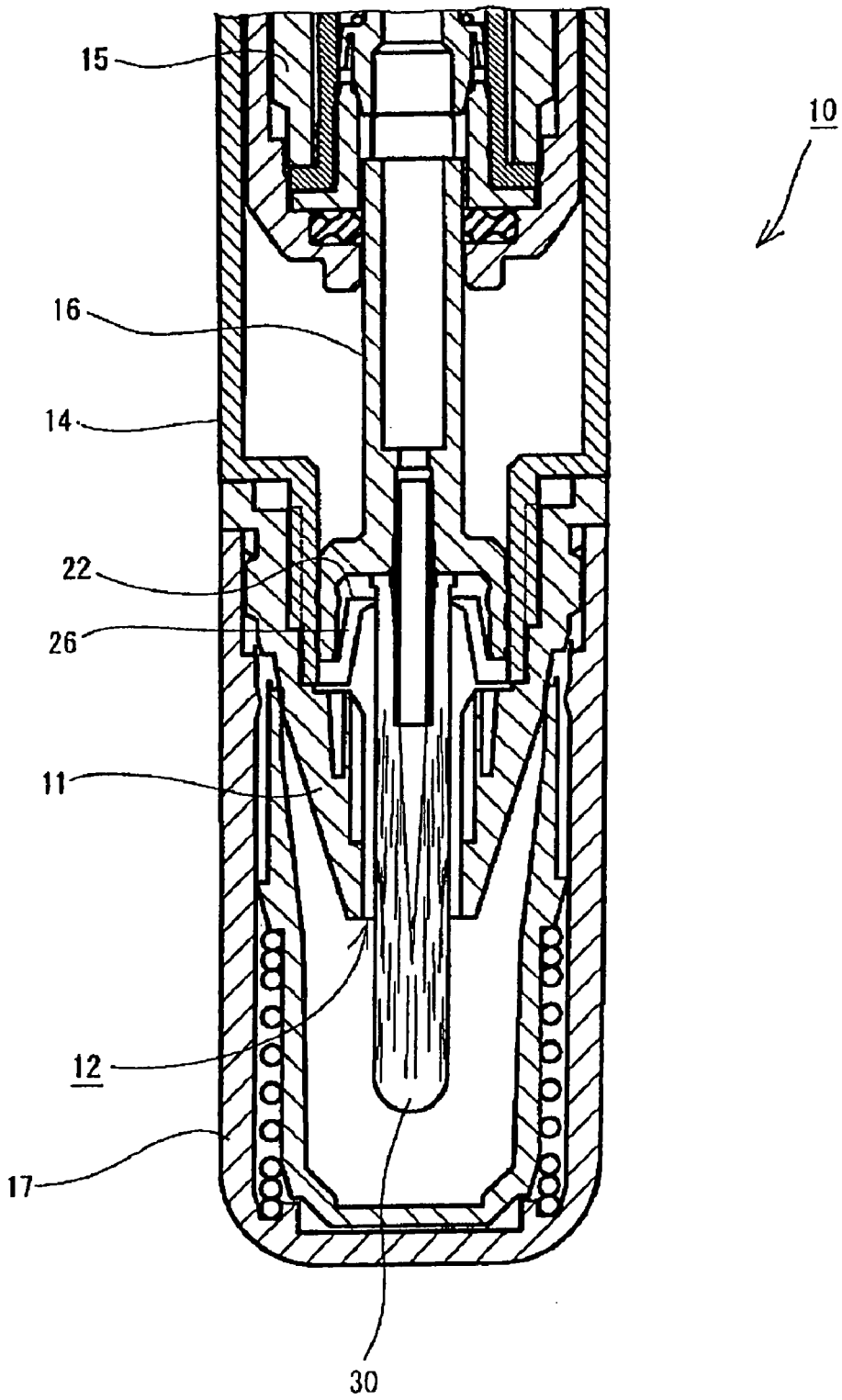
FIG. 14 A front sectional view of a cosmetic-containing applicator according to a fifth embodiment of the present invention.

FIG. 14 is a front sectional view of the cosmetic-containing applicator 10 according to a fifth embodiment of the present invention.

A rear casing 14 is made of a thermoplastic resin, and at the outer periphery in its tip end part, external screw is formed to be screwed to the tip casing 11. Moreover, the rear casing 14 houses an accommodating part 15 that contains liquid cosmetics. Further, to the tip end of the accommodating part 15, a thermoplastic-resin made tubular guiding part 16 for guiding the cosmetics is connected. Both of the inner diameter and the outer diameter of the tip end part of the guiding part 16 are widened.

Figure 15:
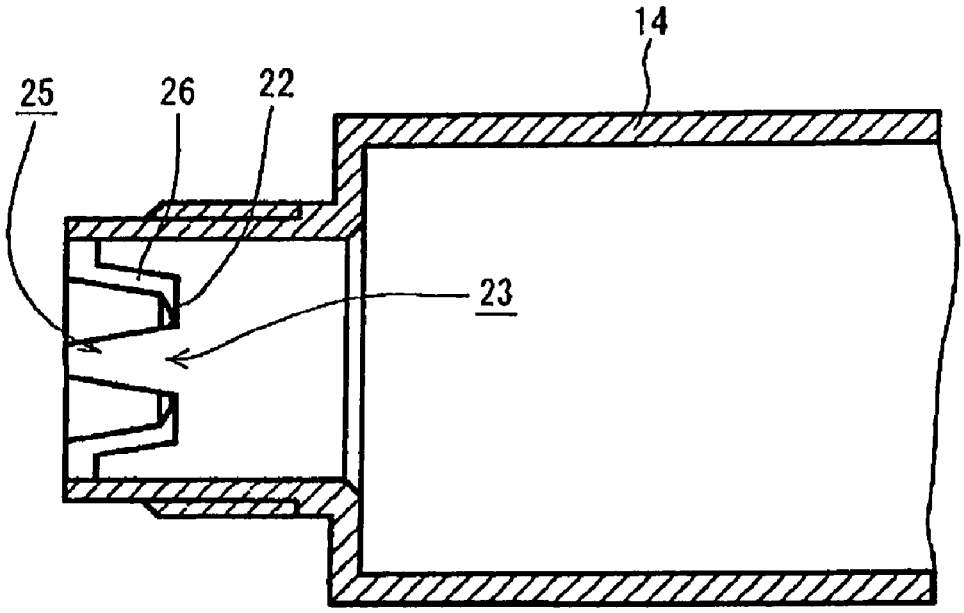
FIG. 15 A front sectional view of a rear casing used for a cosmetic-containing applicator according to a fifth embodiment of the present invention.

Further, the tip end part of the rear casing 14 extends into the interior of the tip end part having an increased diameter of the guiding part 16 fitted in the rear end direction, and the inner diameter of its rear end edge is decreased, by which a bottom surface 22 provided with a circular center hole 23 is formed. Further, as shown in FIG. 15, four slits 25 arranged at equal intervals of 90 degrees are provided radially from the center hole 23. That is to say, the fitting part of the tip end of the rear casing 14 is divided into four parts by the slits 25, and each of the four parts serves as a holding piece 26 having a claw-shaped structure projecting in the center direction in the rear end part.

On the other hand, the tip casing 11 is made of a thermoplastic resin, and at the inner periphery in its tip end part, internal screw is formed so that the tip casing 11 is screwed to the rear casing 14. Moreover, at the tip end of the tip casing 11 screwed to the rear casing 14, a cap 17 for protecting the tip end when the applicator 10 is not in use is detachably mounted. The tip casing 11 is formed with an insertion hole 12 serving as a penetrating hole through which the applicator body 30 is inserted.

As in the first embodiment, as shown in FIG. 3(A), the applicator body 30 is formed as a fiber bundle formed by stiffening and bundling the rear end side of the brush-shaped fibers by using an adhesive. Then, at its rear end, a flange-shaped engagement part 31 is formed. As shown in FIG. 14, the outer diameter of the engagement part 31 is larger than the diameter of the center hole 23 that is a smallest-diameter part of the holding pieces 26. As shown in FIG. 3(B), the outside of the applicator body 30 is covered with a cylindrical protective cylinder 32 having a slit 33 extending in the lengthwise direction over the entire length, by which a replacement brush 34 shown in FIG. 3(C) is formed.

The holding piece 26 in this embodiment is provided with flexibility by the slit 25, and can accomplish the same function as that of the holding piece 26 formed as a part of the sealing ring 20 in the first embodiment.

Specifically, when the replacement brush 34 is inserted into the insertion hole 12, the engagement part 31 comes into contact with the smallest-diameter part of the holding pieces 26, and presses it rearward. Then, the center hole 23 is forced open by the engagement part 31, by which the engagement part 31 and the center hole 23 are elastically deformed by each other. After the engagement part 31 has passed through the center hole 23, the holding pieces 26 restore to their original positions. That is to say, since the outer diameter of the engagement part 31 is larger than the diameter of the center hole 23 as shown in FIG. 12, the frontward movement of the engagement part 31 is hindered. Successively, the protective cylinder 32 is pulled out, by which the mounting of the applicator body 30 is finished. Further, the removal of the applicator body 30 can also be accomplished as in the first embodiment by pulling out the applicator body 30 forward.

INDUSTRIAL APPLICABILITY

The present invention can be applied to a container accommodating cosmetics, such as nail polish or lip-gloss, which are required to be immersed in an applicator in proper amounts and applied to an aimed location.

The invention claimed is:

1. A cosmetic-containing applicator mounted, at its tip end, with an applicator body in which a flange-shaped engagement part is formed at an outer periphery at a rear end of a fiber bundle, comprising:

a rear casing provided with an accommodating part accommodating liquid cosmetics;

a tip casing mounted at a tip end side of the rear casing and formed with an insertion hole in which the applicator body is insertible;

a guiding part for guiding the cosmetics from the accommodating part to the applicator body in the tip casing; and a sealing ring interposed between the guiding part and the tip casing;

a rear end art of the insertion hole in the tip casing being formed as a holding space having an increased inner diameter;

a tip end part of the guiding part fitting in the holding space via the sealing ring;

the sealing ring being formed of an elastically deformable material so as to have a shape in which a short cylindrical holding part, which has a bottom surface having an inner diameter larger than an outer diameter of the engagement part and is provided with a circular center hole having a diameter smaller than the outer diameter of the engagement part on its rear end side, and a flange-shaped sealing part, which is provided at an outer periphery at a tip end edge of the holding part, are integrated together;

a circumference of the center hole being formed as a plurality of claw-shaped holding pieces formed by slits dividing the bottom surface into a plurality of pieces; and the applicator body being inserted in the insertion hole in the tip casing from its rear end, and being mounted in position by causing the engagement part to pass through the center hole in the bottom surface of the sealing ring by elastic deformation.

2. The cosmetic-containing applicator according to claim 1, wherein the slits are arranged at equal intervals.

3. The cosmetic-containing applicator according to claim 2, wherein the slits are provided at two locations, and an opening is provided in each of the holding pieces.

4. The cosmetic-containing applicator according to claim 3, wherein;

the applicator body is formed by providing the engagement part at the outer periphery of the rear end of the brush-shaped fiber bundle formed as a bristle bundle a front end of which is open and a rear end of which is bundled, and a side surface of the applicator body is covered with a detachable protective cylinder having an inner diameter smaller than the outer diameter of the engagement part;

the applicator body is mounted in the tip casing by causing the engagement part to pass through rearward in the holding pieces by elastic deformation of the engagement part and the holding pieces caused by being pressed rearward with the protective cylinder;

the applicator body is made usable by the protective cylinder being pulled out forward and removed after the applicator body has been mounted in position; and the applicator body mounted in the tip casing can be demounted from the tip casing by causing the engagement part to pass through forward in the holding pieces by elastic deformation of the engagement part and the holding pieces caused by the applicator body being pulled forward.

5. The cosmetic-containing applicator according to claim 2, wherein notches are further formed from the slits located on both sides of each of the holding pieces in side surface portions of the holding pieces, whereby the side surface portion of the holding piece is formed into a columnar shape.

6. The cosmetic-containing applicator according to claim 5, wherein:

the applicator body is formed by providing the engagement part at the outer periphery of the rear end of the brush-shaped fiber bundle formed as a bristle bundle a front end of which is open and a rear end of which is bundled, and a side surface of the applicator body is covered with a detachable protective cylinder having an inner diameter smaller than the outer diameter of the engagement part;

the applicator body is mounted in the tip casing by causing the engagement part to pass through rearward in the holding pieces by elastic deformation of the engagement part and the holding pieces caused by being pressed rearward with the protective cylinder;

the applicator body is made usable by the protective cylinder being pulled out forward and removed after the applicator body has been mounted in position; and the applicator body mounted in the tip casing can be demounted from the tip casing by causing the engagement part to pass through forward in the holding pieces by elastic deformation of the engagement part and the holding pieces caused by the applicator body being pulled forward.

7. The cosmetic-containing applicator according to claim 2, wherein:

the applicator body is formed by providing the engagement part at the outer periphery of the rear end of the brush-shaped fiber bundle formed as a bristle bundle a front end of which is open and a rear end of which is bundled, and a side surface of the applicator body is covered with a detachable protective cylinder having an inner diameter smaller than the outer diameter of the engagement part;

the applicator body is mounted in the tip casing by causing the engagement part to pass through rearward in the holding pieces by elastic deformation of the engagement part and the holding pieces caused by being pressed rearward with the protective cylinder;

the applicator body is made usable by the protective cylinder being pulled out forward and removed after the applicator body has been mounted in position; and the applicator body mounted in the tip casing can be demounted from the tip casing by causing the engagement part to pass through forward in the holding pieces by elastic deformation of the engagement part and the holding pieces caused by the applicator body being pulled forward.

8. The cosmetic-containing applicator according to claim 1, wherein:

the applicator body is formed by providing the engagement part at the outer periphery of the rear end of the brush-shaped fiber bundle formed as a bristle bundle a front end of which is open and a rear end of which is bundled, and a side surface of the applicator body is covered with a detachable protective cylinder having an inner diameter smaller than the outer diameter of the engagement part;

the applicator body is mounted in the tip casing by causing the engagement part to pass through rearward in the holding pieces by elastic deformation of the engagement part and the holding pieces caused by being pressed rearward with the protective cylinder;

the applicator body is made usable by the protective cylinder being pulled out forward and removed after the applicator body has been mounted in position; and the applicator body mounted in the tip casing can be demounted from the tip casing by causing the engagement part to pass through forward in the holding pieces by elastic deformation of the engagement part and the holding pieces caused by the applicator body being pulled forward.

9. A replacement brush comprising an applicator body in which a flange-shaped engagement part is formed at an outer periphery of a rear end of a brush-shaped fiber bundle formed as a bristle bundle a front end of which is open and a rear end of which is bundled, a side surface of the applicator body being covered with a detachable protective cylinder having an outer diameter along the entire length thereof approximately equal to an inner diameter of an insertion hole of a cosmetic-containing applicator in which the applicator body is mounted and an inner diameter smaller than an outer diameter of the engagement part.

* * * * *